US006612734B1

(12) United States Patent
Watanabe et al.

(10) Patent No.: US 6,612,734 B1
(45) Date of Patent: Sep. 2, 2003

(54) MECHANICAL TIMEPIECE WITH STUD ADJUSTMENT MECHANISM

(75) Inventors: Mamoru Watanabe, Chiba (JP); Takeshi Tokoro, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/787,854

(22) PCT Filed: Jul. 29, 1999

(86) PCT No.: PCT/JP99/04076

§ 371 (c)(1),
(2), (4) Date: Apr. 27, 2001

(87) PCT Pub. No.: WO01/09687

PCT Pub. Date: Aug. 2, 2001

(51) Int. Cl.[7] ..... G04B 15/00; G04B 1/10; G04B 17/00

(52) U.S. Cl. ..... 368/175; 368/127; 368/140; 368/169

(58) Field of Search ..... 368/175, 203, 368/139, 140, 142, 124–131, 161–169, 127

(56) References Cited

U.S. PATENT DOCUMENTS 3,274,766 A * 9/1966 Desaules et al. ..... 368/177
3,395,532 A * 8/1968 Schneider ..... 368/177
3,429,120 A * 2/1969 Charpilloz ..... 368/177
3,623,314 A * 11/1971 Schneider ..... 368/178
3,638,419 A * 2/1972 Diersbock ..... 368/175
3,698,179 A * 10/1972 Kaulins ..... 368/164
3,792,579 A * 2/1974 Inagaki ..... 368/163
3,842,592 A * 10/1974 Giger ..... 368/178
3,846,612 A * 11/1974 Augsburger ..... 368/177
3,906,714 A * 9/1975 Schneider ..... 368/177
3,956,881 A * 5/1976 Vuille et al. ..... 368/177
4,157,008 A * 6/1979 Perrot ..... 368/169
6,554,468 B1 * 4/2003 Manaka et al. ..... 368/127

* cited by examiner

*Primary Examiner*—David Martin
*Assistant Examiner*—Jeanne-Marguerite Goodwin
(74) *Attorney, Agent, or Firm*—Adams & Wilks

(57) ABSTRACT

A mechanical timepiece movement has a mainspring serving as a power source, a wheel train rotated by a rotational force produced by the mainspring for driving a display, and an escapement and speed control apparatus for controlling rotation of the wheel train and having a balance with hairspring, an escape wheel and pinion and a pallet fork. A stud holder is rotatably mounted with respect to a central axis of the balance with hairspring and a hairspring holder is attached to the stud holder to undergo movement in a direction orthogonal to the central axis of the balance with hairspring. A hairspring has a central portion fixed to the balance with hairspring and an outer portion fixed to the hairspring holder. The hairspring is adjustable by pivoting the hairspring holder.

19 Claims, 7 Drawing Sheets

MECHANICAL TIMEPIECE WITH STUD ADJUSTMENT MECHANISM

TECHNICAL FIELD

The present invention relates to a mechanical time piece having a hairspring holder adjusting mechanism capable of adjusting a position of a hairspring holder.

BACKGROUND OF THE INVENTION

According to a conventional mechanical time piece, as shown in FIG. 6 and FIG. 7, a movement (machine body) 1100 of a mechanical time piece is provided with a main plate 1102 constituting a base plate of the movement. A winding stem 1110 is rotatably integrated to a winding stem guide hole 1102*a* of the main plate 1102. A dial 1104 (shown in FIG. 7 by an imaginary line) is attached to the movement 1100.

Generally, in both sides of the main plate, a side thereof having the dial is referred to as "back side" of the movement and a side thereof opposed to the side having the dial is referred to as "front side" of the movement. A train wheel (or wheel train) integrated to the "front side" of the movement is referred to as "front wheel train" and a train wheel integrated to the "back side" of the movement is referred to as "back train wheel" (or "back wheel train").

The position in the axis line direction of the winding stem 1110 is determined by a switch apparatus including a setting lever 1190, a yoke 1192, a yoke spring 1194 and a setting lever jumper 1196. A winding pinion 1112 is provided rotatably at a guide shaft portion of the winding stem 1110. When the winding stem 1110 is rotated in the state in which the winding stem 1110 is disposed at a first winding stem position (0-stage) which is the position furthest inward along the stem axis, the winding pinion 1112 is rotated via rotation of a clutch wheel. A crown wheel 1114 is rotated by rotation of the winding pinion 1112. A ratchet wheel 1116 is rotated by rotation of the crown wheel 1114. By rotating the ratchet wheel 1116, a mainspring 1122 contained in a barrel 1120 is wound up. A center wheel & pinion 1124 is rotated by rotation of the barrel 1120. An escape wheel & pinion 1130 is rotated via rotation of a fourth wheel & pinion 1128, a third wheel & pinion 1126 and the center wheel & pinion 1124. The barrel 1120, the center wheel & pinion 1124, the third-wheel & pinion 1126 and the fourth wheel & pinion 1128 constitute a front wheel train.

An escapement & speed control apparatus for controlling rotation of the front wheel train includes a balance with hairspring 1140, the escape wheel & pinion 1130 and a pallet fork 1142. The balance with hairspring 1140 includes a balance stem 1140*a*, a balance wheel 1140*b* and a hairspring 1140*c*. Based on rotation of the center wheel & pinion 1124, a cannon pinion 1150 is simultaneously rotated. A minute hand 1152 attached to the cannon pinion 1150 displays "minute". The cannon pinion 1150 is provided with a slip mechanism relative to the center pinion & wheel 1124. Based on rotation of the cannon pinion 1150, via rotation of a minute wheel (not illustrated), an hour wheel 1154 is rotated. An hour hand 1156 attached to the hour wheel 1154 displays "hour".

The barrel 1120 is supported rotatably by the main plate 1120 and a barrel bridge 1160. The center wheel & pinion 1124, and the third wheel & pinion 1126, the fourth wheel & pinion 1128 and the escape wheel & pinion 1130 are supported rotatably by the main plate 1102 and a train wheel bridge 1162. The pallet fork 1142 is supported rotatably by the main plate 1102 and a pallet bridge 1164. The balance with hairspring 1140 is supported rotatably by the main plate 1102 and a balance bridge 1166.

The hairspring 1140*c* is a leaf spring in a helical (spiral) shape having a plural turn number. The inner end portion of the hairspring 1140*c* is fixed to an inner hairspring holder 1140*d* fixed to the balance stem 1140*a*. A stud support 1170 is rotatably attached to the balance bridge 1166. The rotational center of the stud support 1170 is the same as the rotational center of the balance with hairspring 1140.

As shown in FIG. 6 through FIG. 9, a hairspring holder 1172 is fixedly screwed to the stud support 1170 by a hairspring holder screw 1174. The outer end portion of the hairspring 1140*c* is fixed to the hairspring holder 1172. In a state in which the hairspring holder screw 1174 is loosened, the hairspring holder 1172 can be moved in a direction in parallel with the axis line of the balance with hairspring 1140.

A regulator 1168 is attached rotatably to the balance bridge 1166. A hairspring bridge 1168*a* and a hairspring rod 1168*b* are attached to the regulator 1168. A portion of the hairspring 1140*c* proximate to the outer end portion is disposed between the hairspring bridge 1168*a* and the hairspring rod 1168*b*.

However, according to the conventional mechanical time piece, the hairspring holder can be moved only in a direction in parallel with the axis line of the balance with hairspring. Therefore, in fabricating a highly accurate mechanical time piece, it has been difficult to effectively carry out an operation of aligning the rotational center of the balance with hairspring and the center of the hairspring (the so-called operation of "centering of rotation of hairspring"). That is, according to the operation of centering of rotation of the hairspring, there is needed an operation of adjusting the original shape of the hairspring by using hairspring tweezers.

The operation of adjusting the original shape of the hairspring is a very difficult operation even in the case in which an operator having a highly skilled technique carries out the operation. Therefore, there poses a problem in which fabrication of a highly accurate mechanical time piece requires an operator having a highly skilled technique and a long period of time.

It is an object of the invention to provide a mechanical time piece having a hairspring holder adjusting mechanism constituted such that the position of a hairspring holder relative to a rotational center of a balance with hairspring can be adjusted simply and firmly.

It is another object of the invention to provide a highly accurate mechanical time piece capable of easily carrying out adjustment of the original shape of a hairspring and facilitating fabrication thereof.

DISCLOSURE OF THE INVENTION

According to the invention, there is provided a mechanical time piece characterized in that in a mechanical time piece having a mainspring constituting a power source of the mechanical time piece, a front wheel train rotated by the rotational force from rewinding the mainspring and an escapement & speed control apparatus for controlling rotation of the front wheel train in which the escapement & speed control apparatus is constituted to include a balance with hairspring alternately repeating right rotation and left rotation, an escape wheel & pinion rotated based on the rotation of the front wheel train and a pallet fork for controlling rotation of the escape wheel & pinion based on an operation of the balance with hairspring, the mechanical time piece comprising a stud holder provided rotatably to a central axis line of a balance with hairspring, a hairspring holder attached to the stud holder to be movable orthogonal to the central axis line of the balance with hairspring, and a hairspring an inner end portion of which is fixed to the balance with hairspring and an outer end portion of which is fixed to the hairspring holder in the mechanical time piece having the mainspring constituting the power source of the mechanical time piece, the front wheel train rotated by the rotational force of rewinding the mainspring and the escapement & speed control apparatus for controlling the rotation of the front wheel train in which the escapement & speed control apparatus is constituted to include the balance with hairspring alternately repeating right rotation and left rotation, the escape wheel & pinion rotated based on the rotation of the front wheel train and the pallet fork for controlling the rotation of the escape wheel & pinion based on the operation of the balance with hairspring.

According to the mechanical time piece of the invention, it is preferable that an eccentric pin is rotatably attached to the stud holder, the eccentric pin includes an eccentric hole and the hairspring holder is integrated to the eccentric hole.

Further, according to the mechanical time piece of the invention, it is preferable that the mechanical time piece further comprises a hairspring holder setscrew for fixing the hairspring holder to the stud holder, wherein the eccentric pin includes a lateral hole formed in a shape of a long hole which is elongated at the opening such that the length thereof orthogonal to the central axis line is long and the length thereof the same direction as the central axis line is short, and the front end of the hairspring holder setscrew penetrates the lateral hole of the eccentric pin and fixes the hairspring holder by pressing on it.

Further, according to the mechanical time piece of the invention, it is preferable that the hairspring holder is rotatably integrated to the eccentric pin.

By constituting the mechanical time piece in this way, adjustment of an original shape of the hairspring holder can easily be carried out.

Further, according to the mechanical time piece of the invention, the eccentric pin is rotatably attached to the stud holder and accordingly, fabrication of the mechanical timepiece and adjustment of the hairspring are facilitated.

BRIEF DESCRIPTION OF THE DRAWINGS

(in FIG. 1, portions of parts are omitted and bridge members are indicated by imaginary lines).

BEST MODE FOR CARRYING OUT THE INVENTION

An explanation will be given of embodiments of a mechanical time piece according to the invention in reference to the drawings as follows.

Figure 1:
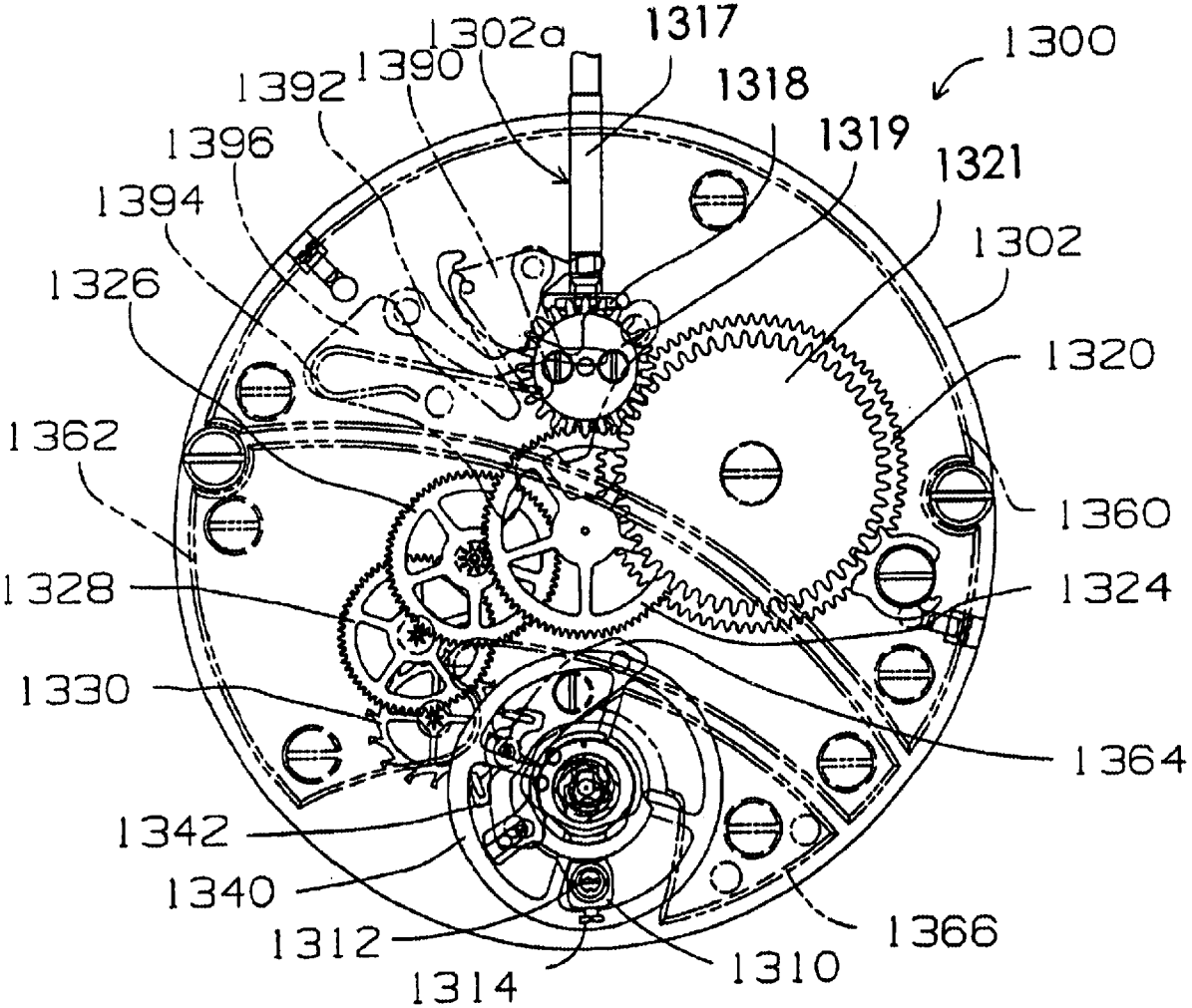
FIG. 1 is a plane view showing an outline shape of a front side of a movement of a mechanical time piece according to the invention.
Figure 2:
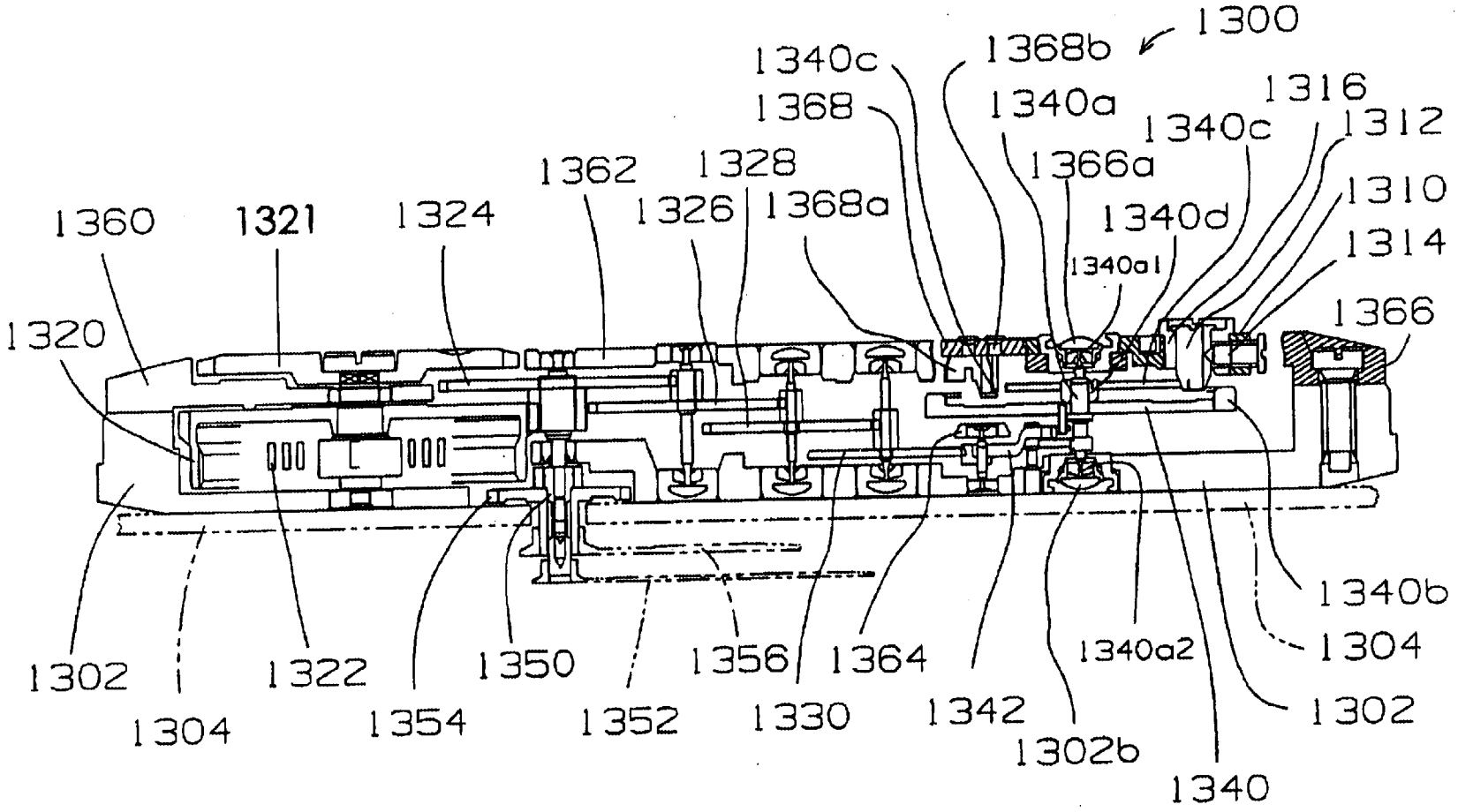
FIG. 2 is an outline partial sectional view of the movement of the mechanical time piece according to the invention (in FIG. 2, portions of parts are omitted).
Figure 3:
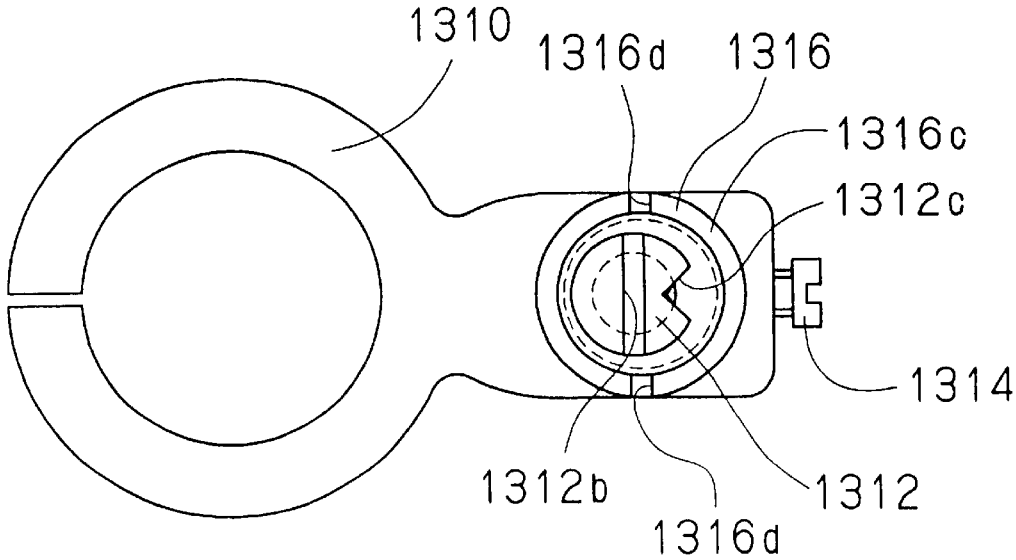
FIG. 3 is an enlarged partial plane view of a stud support of the mechanical time piece according to the invention.
Figure 4:
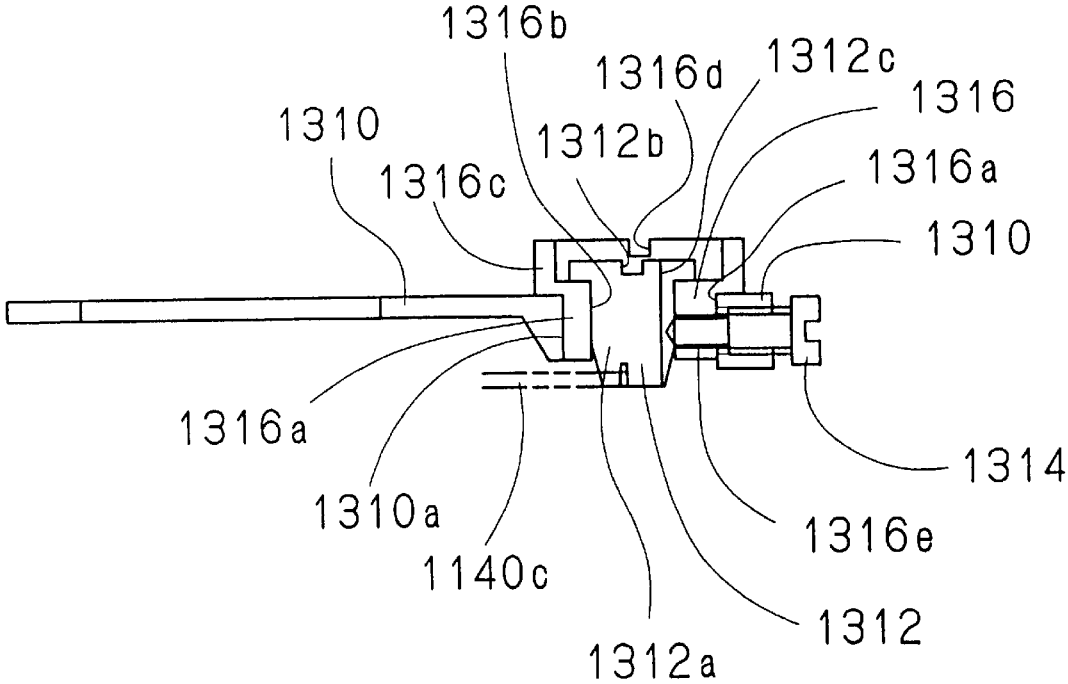
FIG. 4 is an enlarged partial sectional view of the stud support of the mechanical time piece according to the invention.

In reference to FIG. 1 and FIG. 2, according to an embodiment of a mechanical time piece of the invention, a movement (machine body) 1300 of the mechanical time piece is provided with a main plate 1302 constituting a base plate of the movement. A winding stem 1317 is rotatably integrated to a winding stem guide hole 1302*a* of the main plate 1302. A dial 1304 (shown in FIG. 2 by an imaginary line) is attached to the movement 1300.

The winding stem 1317 is provided with a square portion and a guide shaft portion. A clutch wheel (not illustrated) is integrated to the square portion of the winding stem 1310. The clutch wheel is provided with a rotational axis line the same as a rotational axis line of the winding stem 1317. That is, the clutch wheel is provided with a square hole and is provided to rotate based on rotation of the winding stem 1317 by fitting the square portion of the winding stem 1317 to the square hole. The clutch wheel is provided with teeth A and teeth B. The teeth A are provided at the end portion of the clutch wheel proximate to the center of the movement. The tooth B are provided at the end portion of the clutch wheel proximate to an outer side of the movement.

The movement 1300 is provided with a switch apparatus for determining the position of the winding stem 1317 in the axis line direction. The switch apparatus includes a setting lever 1390, a yoke 1392, a yoke spring 1394 and a setting lever jumper 1396. Based on rotation of the setting lever, the position in the rotational axis line of the winding stem 1317 is determined. Based on rotation of the yoke, the position in the rotational axis line direction of the clutch wheel is determined. Based on rotation of the yoke, the position in the rotational axis line direction of the clutch wheel is determined. Based on rotation of the setting lever, the yoke is positioned to two positions in the rotational direction.

A winding pinion 1318 is provided rotatably at the guide shaft portion of the winding stem 1317. When the winding stem 1317 is rotated in a state in which the winding stem 1317 is disposed at a first winding stem position (0-stage) most proximate to the center of the movement along the rotational axis line, the winding pinion 1318 is constituted to rotate via rotation of the clutch wheel. A crown wheel 1319 is constituted to rotate by rotation of the winding pinion 1312. A ratchet wheel 1321 is constituted to rotate by rotation of the crown wheel 1319.

The movement 1300 is provided with a mainspring 1322 contained in a barrel 1320 as its power source. The mainspring 1322 is made of an elastic material having spring performance such as iron. By rotating the ratchet wheel 1321, the mainspring 1322 is constituted to be capable of being wound up.

A center wheel & pinion 1324 is constituted to rotate by rotation of the barrel 1320. A third wheel & pinion 1326 is constituted to rotate based on rotation of the center wheel & pinion 1324. A fourth wheel & pinion 1328 is constituted to rotate based on rotation of the third wheel & pinion 1326. An escape wheel & pinion 1330 is constituted to rotate based on rotation of the fourth wheel & pinion 1328. The barrel 1320, the center wheel & pinion 1324, the third wheel & pinion 1326 and the fourth wheel & pinion 1328 constitute the front wheel train.

The movement 1300 is provided with an escapement & speed control apparatus for controlling rotation of the front wheel train. The escapement & speed control apparatus includes a balance with hairspring 1340 repeating right rotation and left rotation at a constant period, the escape wheel & pinion 1330 rotating based on rotation of the front wheel train and a pallet fork 1342 for controlling rotation of the escape wheel & pinion 1330 based on operation of the balance with hairspring 1340.

The balance with hairspring 1340 includes a balance stem 1340*a*, a balance wheel 1340*b* and a hairspring 1340*c*. The hairspring 1340*c* is made of an elastic metallic material having spring performance such as "elinbar".

Based on rotation of the center wheel & pinion 1324, a cannon pinion 1350 is simultaneously rotated. A minute hand 1352 attached to the cannon pinion 1350 is constituted to display "minute". The cannon pinion 1350 is provided with a slip mechanism having a predetermined slip torque relative to the center wheel & pinion 1324.

Based on rotation of the cannon pinion 1350, a minute wheel (not illustrated) is rotated. Based on rotation of the minute wheel, an hour wheel 1354 is rotated. An hour hand 1356 attached to the hour wheel 1354 is constituted to display "hour".

The barrel complete 1320 is supported rotatably by the main plate 1302 and a barrel bridge 1360. The center wheel & pinion 1324, the third wheel & pinion 1326, the fourth wheel & pinion 1328 and the escape wheel & pinion 1330 are supported rotatably by the main plate 1302 and a wheel train bridge 1362. The pallet fork 1342 is supported rotatably by the main plate 1302 and a pallet bridge 1364.

The balance with hairspring 1340 is supported rotatably by the main plate 1302 and a balance bridge 1366. That is, an upper mortise 1340*a*1 of the balance stem 1340*a* is supported rotatably by a balance upper bearing 1366*a* fixed to the balance bridge 1366. The balance upper bearing 1366*a* includes a balance upper hole jewel and a balance upper cap jewel. The balance upper hole jewel and the balance upper cap jewel are made of an insulating material such as ruby.

A lower mortise 1340*a*2 of the balance stem 1340*a* is supported rotatably by a balance lower bearing 1302*b* fixed to the main plate 1302. The balance lower bearing 1302*b* includes a balance lower hole jewel and a balance lower cap jewel. The balance lower hole jewel and the balance lower cap jewel are made of an insulating material such as ruby.

The hairspring 1340*c* is a leaf spring in a helical (spiral) shape having a plurality. The end portion of the hairspring 1340*c* toward the center is fixed to an inner hairspring holder 1340*d* fixed to the balance stem 1340*a*. A stud holder 1310 is rotatably attached to the balance bridge 1366. The rotational center of the stud holder 1310 is the same as the rotational center of the balance with hairspring 1340.

Next, an explanation will be given of a detailed structure of the stud holder 1310 of the mechanical time piece according to the invention.

As shown in FIG. 1 through FIG. 4, an eccentric pin 1316 is rotatably attached to the stud holder 1310.

Figure 5:
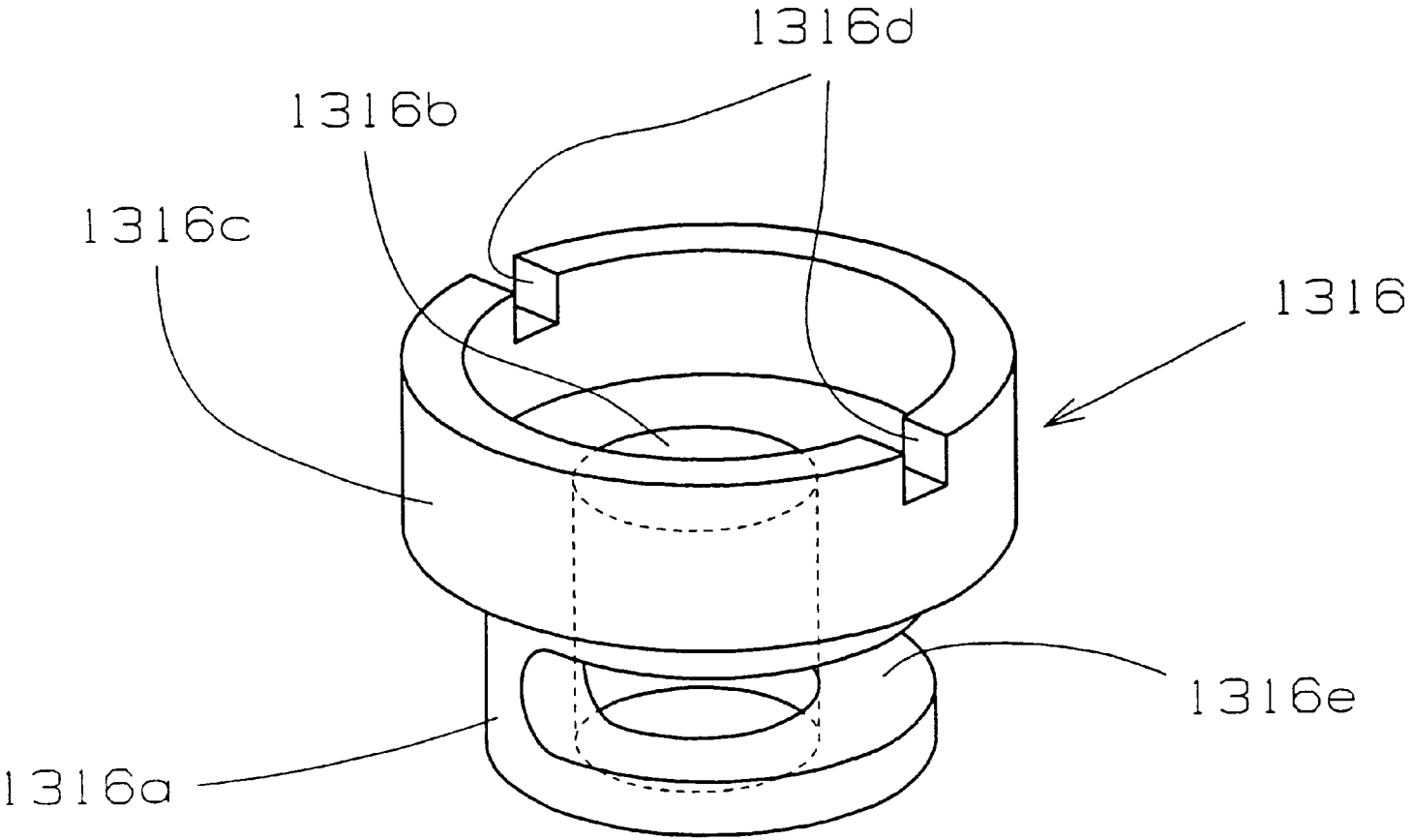
FIG. 5 is an enlarged perspective view of an eccentric pin of the mechanical time piece according to the invention.
Figure 6:
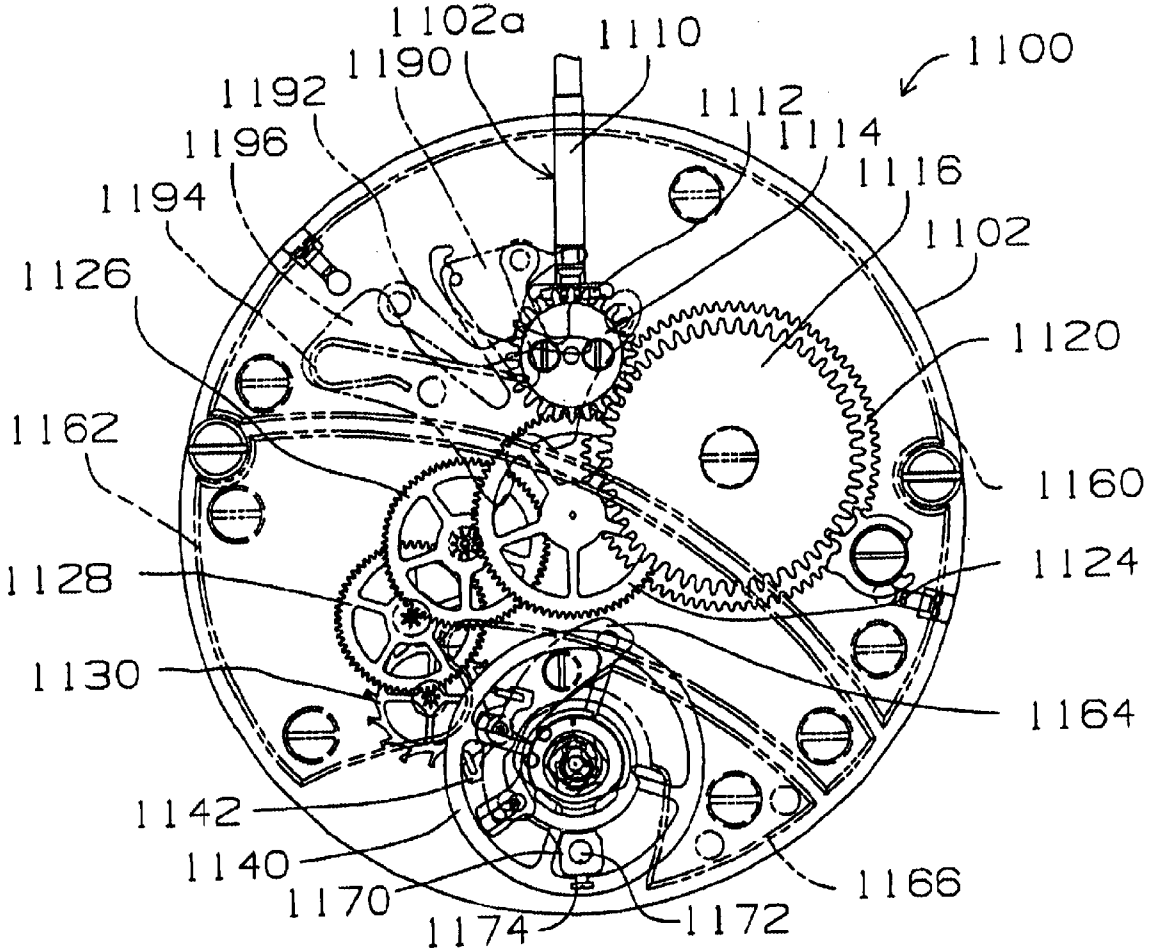
PRIOR ART FIG. 6
FIG. 6 is a plane view showing an outline shape of a front side of a movement according to a conventional mechanical time piece (in FIG. 6, portions of parts are omitted and bridge members are indicated by imaginary lines).
Figure 7:
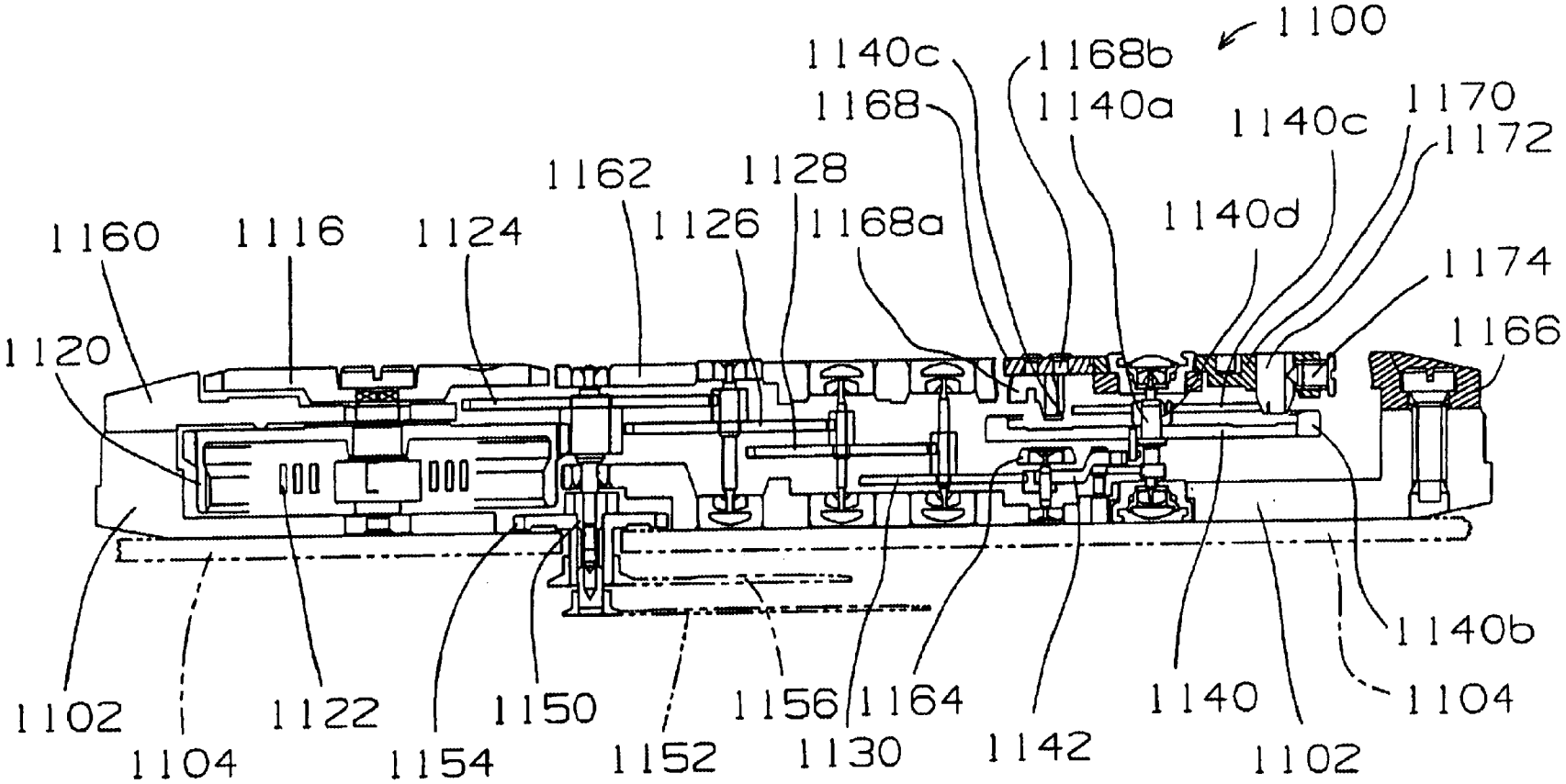
PRIOR ART FIG. 7
FIG. 7 is an outline partial sectional view of the movement of the conventional mechanical time piece (in FIG. 7, portions of parts are omitted).
Figure 8:
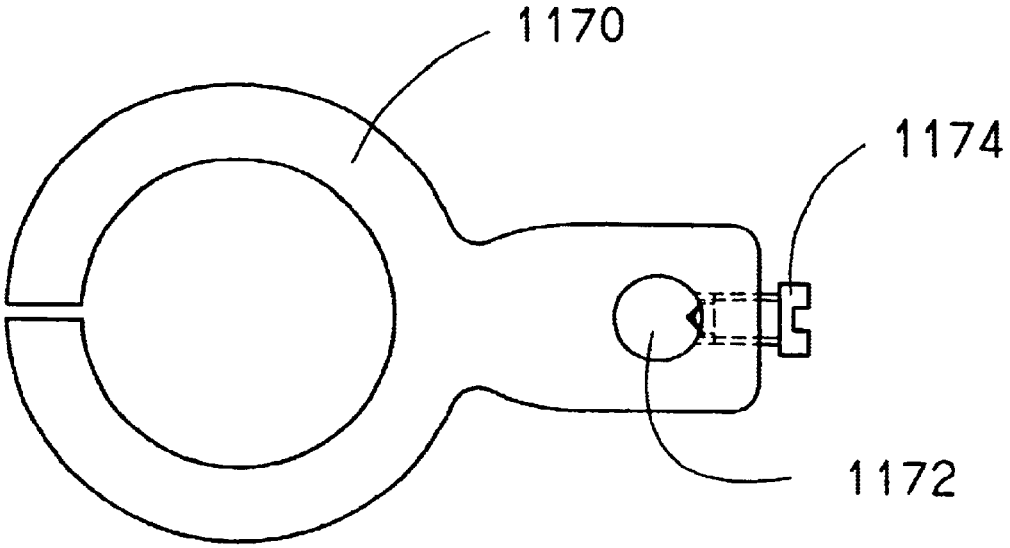
PRIOR ART FIG. 8
FIG. 8 is an enlarged partial plane view of a stud support of the conventional mechanical time piece.
Figure 9:
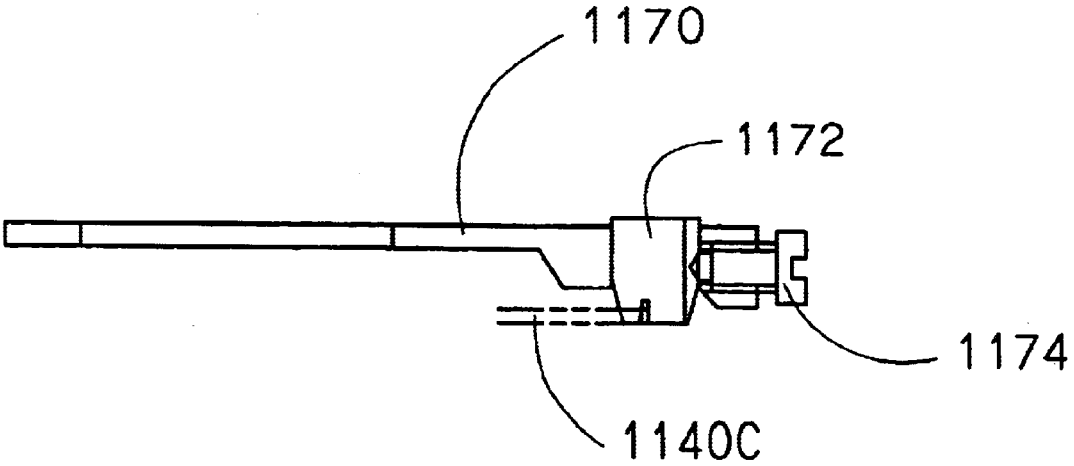
PRIOR ART FIG. 9
FIG. 9 is an enlarged partial sectional view of the stud support of the conventional mechanical time piece.

In reference to FIG. 5, the eccentric pin 1316 includes a fitting cylindrical portion 1316*a*, an eccentric hole 1316*b*, and an outer peripheral cylindrical portion 1316*c* provided with slit portions 1316*d* and a lateral hole 1316*e*. The central axis line of the fitting cylindrical portion 1316*a* of the eccentric pin 1316 is eccentric to the central axis line of the eccentric hole 1316*b* of the eccentric pin 1316. The central axis line of the fitting cylindrical portion 1316*a* of the eccentric pin 1316 is the same as the central axis line of the outer peripheral cylindrical portion 1316*c* of the eccentric pin 1316.

The lateral hole 1316*e* of the eccentric pin 1316 is provided to penetrate a portion of a wall of the fitting cylindrical portion 1316*a* from an outer periphery of the fitting cylindrical portion 1316*a* to the eccentric hole 1316*b*. Inner wall faces of the lateral hole 1316*e* of the eccentric pin 1316 are constituted to be orthogonal to the central axis line of the fitting cylindrical portion 1316*a* of the eccentric pin 1316.

The lateral hole 1316*e* of the eccentric pin 1316 is formed in a shape of a long hole which is elongated at the opening such that the length thereof orthogonal to the central axis line of the fitting cylindrical portion 1316*a* of the eccentric pin 1316 is long and the length thereof in the same direction as the central axis line of the fitting cylindrical portion 1316*a* is short. For example, the lateral hole 1316*e* of the eccentric pin 1316 is formed at an angle of a range of 90 through 180 degree relative to the central axis line of the fitting cylindrical portion 1316*a*.

Further, as the lateral hole 1316*e* of the eccentric pin 1316, the fitting cylindrical portion 1316*a* of the eccentric pin 1316 may be formed with a plurality of round holes to direct to the central axis line.

As shown in FIG. 1 through FIG. 4, a hairspring holder 1312 includes a fitting shaft portion 1312*a*, a slit portion 1312*b* and a cut portion 1312*c*.

The outer periphery of the fitting cylindrical portion 1316*a* of the eccentric pin 1316 is rotatably integrated into an eccentric pin hole 1310*a* of the stud holder 1310. The hairspring holder 1312 is rotatably integrated into the eccentric hole 1316*b* of the eccentric pin 1316.

The hairspring holder cut portion 1312*c* is provided at an outer peripheral portion of the hairspring holder 1312. Wall faces of the hairspring holder cut portion 1312*c* are constituted in parallel with the central axis line of the hairspring holder 1312.

A hairspring holder setscrew 1314 is screwed to a screw hole of the stud holder 1310. Fixing of the hairspring holder 1312 to the stud holder 1310 is carried out by screwing the hairspring holder setscrew 1314 to the stud holder 1310 in a state in which the front end of the hairspring holder setscrew 1314 penetrates the lateral hole 1316*e* of the eccentric pin 1316 and presses the cut portion 1312*c* of the hairspring holder 1312.

The central axis line of the hairspring holder setscrew 1314 is constituted to be orthogonal to the central axis line of the fitting cylindrical portion 1316*a* of the eccentric pin 1316 after fixing the hairspring holder 1312. Further, the central axis line of the hairspring holder setscrew 1314 is constituted to be orthogonal to the central axis line of the hairspring holder 1312 after fixing the hairspring holder 1312.

The end portion of the hairspring 1340*c* toward the periphery is fixed to a hairspring receiving portion provided at a lower end portion of the hairspring holder 1312.

A regulator 1368 is rotatably attached to the balance bridge 1366. A hairspring bridge 1368*a* and a hairspring rod 1368*b* are attached to the regulator 1368. A portion of the hairspring 1340*c* proximate to its peripheral end is disposed between the hairspring bridge 1368*a* and the hairspring rod 1368*b*.

The hairspring 1340*c* is elongated and contracted in the radius direction of the hairspring 1340*c* in accordance with the rotational angle the balance with hairspring 1340. For example, in the state shown by FIG. 1, when the balance with hairspring 1340 is rotated in the clockwise direction, the hairspring 1340*c* is contracted toward the center of the balance with hairspring 1340, and when the balance with hairspring 1340 is rotated in the counterclockwise direction, the hairspring 1340*c* is expanded away from the center of the balance with hairspring 1340.

Next, an explanation will be given of the operation of adjusting the position of the hairspring holder 1312 in the embodiment of the mechanical time piece according to the invention.

In reference to FIG. 1 through FIG. 4, the hairspring holder setscrew 1314 is loosened and the front end of the hairspring holder setscrew 1314 is separated from the wall faces of the hairspring holder cut portion 1312*c*. In such a state in which the hairspring holder setscrew 1314 is loosened, the eccentric pin 1316 can be rotated.

Next, a front end of a driver (not illustrated) is inserted into the slit portions 1316*d* of the eccentric pin 1316 and rotated to thereby rotate the eccentric pin 1316. By rotating the eccentric pin 1316, a position of the hairspring holder 1312 integrated to the eccentric pin 1316 is changed. That is, by rotating the eccentric pin 1316, a position of the eccentric hole 1316*b* of the eccentric pin 1316 is changed, as a result, a distance between the central axis line of the eccentric hole 1316*b* of the eccentric pin 1316 and the central axis line of the balance with hairspring 1340 is changed.

Next, a front end of a driver (not illustrated) is inserted into the slit portion 1312*b* of the hairspring holder 1312 and the driver is rotated to thereby rotate the hairspring holder 1312. Thereby, the position and the direction of the outer end portion of the hairspring 1340*c* can be adjusted highly accurately.

Next, the hairspring holder setscrew 1314 is screwed to the stud holder 1310 by bringing the front end portion of the hairspring holder setscrew 1314 into a state in which the front end portion penetrates the lateral hole 1316*e* of the eccentric pin 1316 and presses the cut portion 1312*c* of the hairspring holder 1312. Thereby, the position of the outer end portion of the hairspring 1340*c* is determined.

As has been explained above, according to the invention, in the mechanical time piece, there is constructed the constitution having the stud holder provided rotatably to the central axis line of the balance with hairspring (1340), the hairspring holder attached to the stud holder to be movable in the direction orthogonal to the central axis line of the balance with hairspring and the hairspring the center-facing end of which is fixed to the balance with hairspring and the periphery-facing end of which is fixed to the hairspring holder and accordingly, the position of the hairspring holder relative to the rotational center of the balance with hairspring can be adjusted simply and firmly and adjustment of the original shape of the hairspring can easily be carried out. Therefore, fabrication of the mechanical time piece of the invention is facilitated.

INDUSTRIAL APPLICABILITY

The mechanical time piece of the invention is suitable for realizing a highly accurate mechanical time piece constituted to be able to firmly adjust a position of a hairspring holder.

What is claimed is:

1. A mechanical timepiece movement comprising: a mainspring serving as a power source of the mechanical timepiece; a front wheel train rotated by a rotational force produced by the mainspring for driving a time-indicating display; and an escapement and speed control apparatus for controlling rotation of the front wheel train and comprising a balance with hairspring for undergoing repetitive rotation in alternating directions, an escape wheel and pinion mounted to undergo rotation based on the rotation of the front wheel train, and a pallet fork for controlling rotation of the escape wheel and pinion based on the repetitive rotation of the balance with hairspring; wherein the balance with hairspring has a stud holder rotatably mounted with respect to a central axis of the balance with hairspring, a hairspring holder attached to the stud holder to undergo movement in a direction orthogonal to the central axis of the balance with hairspring, and a hairspring having a central portion fixed to the balance with hairspring and an outer peripheral portion fixed to the hairspring holder so that the hairspring is adjustable by pivoting the hairspring holder.

2. A mechanical timepiece movement according to claim 1; wherein the balance with hairspring further comprises an eccentric pin rotatably mounted to the stud holder, the eccentric pin having an eccentric hole formed axially therethrough, and wherein the hairspring holder is rotatably disposed in the eccentric hole.

3. A mechanical timepiece movement according to claim 2; wherein the balance with hairspring further comprises a hairspring holder set screw for fixing the hairspring holder to the stud holder; wherein the eccentric pin has an elongated hole formed in an outer peripheral surface thereof to extend from the outer peripheral surface to the eccentric hole, the elongated hole having a longer length in a circumferential direction of the eccentric pin than in an axial direction thereof; and wherein a front end of the hairspring holder set screw penetrates the elongated hole of the eccentric pin and fixes the hairspring holder by pressing against the hairspring holder.

4. A mechanical timepiece movement according to claim 3; wherein the hairspring holder is rotatably inserted in the eccentric hole of the eccentric pin.

5. A mechanical timepiece movement according to claim 1; further comprising a base plate having a first surface for supporting the mainspring, the front wheel train, the escapement and speed control apparatus, the stud holder, and the balance with hairspring.

6. A mechanical timepiece movement according to claim 5; further comprising a dial mounted to a second surface of the base plate opposite the first surface; and a time-indicating member driven by the front wheel train to cooperate with the dial to indicate time.

7. A mechanical timepiece movement according to claim 5; further comprising a winding stem guide hole formed in the base plate; and a winding stem inserted in the guide hole to be axially and rotatably movable with respect thereto for winding the mainspring and setting a time.

8. A mechanical timepiece movement according to claim 1; wherein the front wheel train comprises a barrel containing the mainspring, a center wheel and pinion mounted to undergo rotation with the barrel, and one or more other wheels and pinions mounted to undergo rotation with the center wheel and pinion to drive the time-indicating display.

9. A mechanical timepiece movement according to claim 1; further comprising a cannon wheel mounted to undergo rotation with the front wheel train for driving time-indicating members of the time-indicating display.

10. A timepiece movement comprising: a mainspring; a wheel train rotated by the mainspring; a time-indicating display driven by the wheel train; and a control apparatus for controlling rotation of the wheel train and having a balance with hairspring for undergoing repetitive rotation in alternating directions, the balance with hairspring having a rotating stem, a stud holder rotatably mounted with respect to a central axis of the rotating stem, a hairspring holder attached to the stud holder to undergo movement in a direction orthogonal to the central axis of the stem, and a hairspring having a central portion fixed to the stem and an outer peripheral portion fixed to the hairspring holder so that the hairspring is adjustable by pivoting the hairspring holder.

11. A timepiece movement according to claim 10; wherein the control apparatus further comprises an escape wheel and pinion mounted to undergo rotation based on the rotation of the wheel train, and a pallet fork for controlling rotation of the escape wheel and pinion based on the repetitive rotation of the balance with hairspring.

12. A timepiece movement according to claim 10; wherein the balance with hairspring further comprises an eccentric pin rotatably mounted to the stud holder, the eccentric pin having an eccentric hole formed axially therethrough, and wherein the hairspring holder is rotatably disposed in the eccentric hole.

13. A timepiece movement according to claim 12; wherein the balance with hairspring further comprises a hairspring holder set screw for fixing the hairspring holder to the stud holder; wherein the eccentric pin has an elongated hole formed in an outer peripheral surface thereof to extend from the outer peripheral surface to the eccentric hole, the elongated hole having a longer length in a circumferential direction of the eccentric pin than in an axial direction thereof; and wherein a front end of the hairspring holder set screw penetrates the elongated hole of the eccentric pin and fixes the hairspring holder by pressing against the hairspring holder.

14. A timepiece movement according to claim 13; wherein the hairspring holder is rotatably inserted in the eccentric hole of the eccentric pin.

15. A timepiece movement according to claim 10; further comprising a base plate having a first surface for supporting the mainspring, the wheel train and the control apparatus.

16. A timepiece movement according to claim 15; further comprising a dial mounted to a second surface of the base plate opposite the first surface; and a time-indicating member driven by the wheel train to cooperate with the dial to indicate time.

17. A timepiece movement according to claim 15; further comprising a winding stem guide hole formed in the base plate; and a winding stem inserted in the guide hole to be axially and rotatably movable with respect thereto for winding the mainspring and setting a time.

18. A timepiece movement according to claim 10; wherein the wheel train comprises a barrel containing the mainspring, a center wheel and pinion mounted to undergo rotation with the barrel, and one or more other wheels and pinions mounted to undergo rotation with the center wheel and pinion to drive the time-indicating display.

19. A timepiece movement according to claim 10; further comprising a cannon wheel mounted to undergo rotation with the front wheel train for driving time-indicating members of the time-indicating display.

* * * * *